US005800054A

United States Patent [19]

Lo

[11] Patent Number: 5,800,054

[45] Date of Patent: Sep. 1, 1998

[54] EASY-ASSEMBLY DUAL-POLE FLOOR LAMP

[75] Inventor: David Lo, Taipei Hsieh, Taiwan

[73] Assignee: Holmes Products Corp., Milford, Mass.

[21] Appl. No.: 810,139

[22] Filed: Feb. 25, 1997

[51] Int. Cl.[6] ..... F21S 13/12

[52] U.S. Cl. ..... 362/431; 362/250; 362/275; 362/414

[58] Field of Search ..... 362/250, 275, 362/269, 287, 410, 411, 414, 431, 427, 430

[56] References Cited

U.S. PATENT DOCUMENTS 5,620,247 4/1997 Swanson ..... 362/431

*Primary Examiner*—Y. My Quach
*Attorney, Agent, or Firm*—Hoffmann & Baron, LLP

[57] ABSTRACT

An easy-assembly dual-pole floor lamp includes a first pole with top and bottom ends and a base portion which is secured to the bottom end of the first pole. The base portion has a lower second-pole-receiving region, and a second-pole-mounting member is secured to the first pole at a predetermined distance above the lower second-pole-receiving region of the base portion. The second-pole-mounting member has an upper second-pole-receiving region. The lamp also includes a second pole which has a top end and a bottom end. The top end is configured to mate with the upper second-pole-receiving region, and the bottom end is configured to mate with the lower second-pole-receiving region. The length of the second pole is adjustable over an adjustment range which extends at least between first and second values; the first value of the length is selected to permit easy insertion of the second pole between the upper and lower second-pole-receiving regions. The second value of the length is selected to permit secure retention of the second pole between the upper and lower second-pole-receiving regions. The lamp can be provided as part of a kit which is easily assembled by the consumer. A method of assembling such a kit is also disclosed.

26 Claims, 9 Drawing Sheets

EASY-ASSEMBLY DUAL-POLE FLOOR LAMP

BACKGROUND OF THE INVENTION

1. Field of the Invention

The present invention relates to illumination, and more particularly relates to an easy-assembly dual-pole floor lamp.

2. Description of the Prior Art

Floors lamps are, of course, well-known devices. Recently, there has been interest in dual-pole floor lamps, wherein two vertical poles are located side-by-side in order to provide a pleasing appearance. A new, original and ornamental design for such a dual-pole lamp is disclosed in applicant's co-assigned U.S. patent application Ser. No. 29/057,973 filed on Aug. 5, 1996.

Heretofore, assembly of such lamps has been relatively difficult. Referring to FIG. 8, there is shown a cross-section through the lower portion of a prior art dual-pole floor lamp designated generally as 10. The lower portion includes a base portion 12 which in turn includes an outer shell 14 and a weight, such as concrete weight 16, in order to provide stability. A first pole 18 is formed with internal threads 20 which engage external threads 22 of an end plug 24. End plug 24 is formed with a through hole having internal threads 26. A threaded hollow stud 28 engages internal threads 26 of end plug 24, and projects through an aperture 30 formed in shell 14 of base portion 12, and another aperture 32 formed in weight 16 of base portion 12. Hollow stud 28 is secured in place by a suitable nut 34. Stud 28 is hollow to permit passage of a lamp cord (not shown).

Second pole 36 of prior art lamp 10 includes internal threads 38 which mate with external threads 40 of an end plug 42. Internal threads 44 of end plug 42 mate with an externally threaded hollow stud 46. Hollow stud 46 passes through an aperture 48 in outer shell 14, and another aperture 50 in weight 16. Hollow stud 46 is secured by a nut 52. In will be appreciated that second pole 36 is secured to base portion 12 in a manner which is similar to that in which first pole 18 is secured to base portion 12.

In a typical dual-pole floor lamp, first pole 18 and second pole 36 are rigidly secured at their upper ends (not shown). The assembly scheme shown in FIG. 8 is capable of providing relatively secure assembly of the bottom ends of the first and second poles 18, 36. However, it is relatively expensive, since a number of parts are required for each pole. Furthermore, assembly of a prior art dual-pole floor lamp is relatively complicated, and may be beyond the capabilities of the typical consumer. This is because relatively precise alignment is required between the two poles, since the locations of the poles with respect to the base portion 12 are essentially fixed by the locations of apertures 30, 32, 48, 50 in outer shell 14 and weight 16 of base portion 12. Time consuming adjustments must be made if the bottom end of second pole 36 does not align with apertures 48, 50 when first pole 18 has been secured to base 12.

In view of the increased popularity of dual-pole floor lamps, as well as the relatively difficult and expensive assembly methods currently employed with such lamps, there is a need for an easy-assembly dual-pole floor lamp which can be readily assembled by a purchaser, using ordinary tools, without undue adjustment. The lamp should also be economical to manufacture. Further, there is a need for a method of assembly for such a lamp. Prior art dual-pole floor lamps, as noted, suffer from the disadvantages of being relatively expensive to manufacture and difficult to assemble.

OBJECTS AND SUMMARY OF THE INVENTION

It is an object of the present invention to provide an easy-assembly dual-pole floor lamp in which the second pole can easily be assembled to the remainder of the lamp without delicate and time-consuming adjustments.

It is another object of the present invention to provide an easy-assembly dual-pole floor lamp which is less expensive to manufacture and requires fewer intricate parts than prior lamps.

It is yet another object of the present invention to provide a kit from which a dual-pole floor lamp of the type described above can be easily assembled.

It is a further object of the present invention to provide a method of assembling such a kit which is less complicated than prior-art methods, and which requires no delicate adjustments.

In accordance with one form of the present invention, an easy-assembly dual-pole floor lamp includes a first pole having a top end and a bottom end. A base portion having a lower second-pole-receiving region is secured to the bottom end of the first pole, and a second-pole-mounting member is secured to the first pole at a predetermined distance above the lower second-pole-receiving region of the base portion. The second-pole-mounting member has an upper second-pole-receiving region. The easy-assembly dual-pole floor lamp also includes a second pole having a top end and a bottom end. The top end of the second pole is configured to mate with the upper second-pole-receiving region, and the bottom end of the second pole is configured to mate with lower second-pole-receiving region.

The second pole has a length which is adjustable over an adjustment range which extends at least between first and second values. The first value of the length is selected for easy insertion of the second pole between the upper and lower second-pole-receiving regions, while the second value of the length is selected for secure retention of the second pole between the upper and lower second-pole-receiving regions. When assembled, the second pole has its length adjusted to the second value and is securely retained between the upper and lower second-pole-receiving regions with the top end of the second pole mated with the upper second-pole-receiving region and the bottom end of the second pole mated with the lower second-pole-receiving region. The lamp also includes a first illuminating assembly mounted on at least one of the first pole, the second pole, and the second-pole-mounting member.

The aforementioned easy-assembly dual-pole floor lamp is preferably provided as part of a kit which includes a base portion and a first pole with a second-pole-mounting member as described above, as well as a second pole of the type described above and a first illuminating assembly of the type described above.

In a method for assembling an easy-assembly dual-pole floor lamp kit, according to the present invention, a first pole, base and mounting member assembly is provided. The assembly includes a first pole having a top end and a bottom end; a base portion which is secured to the bottom end of the first pole and which has a lower second-pole-receiving region; and a second-pole-mounting member which is secured to the first pole at a predetermined distance above the lower second-pole-receiving region, and which is formed with an upper second-pole-receiving region. The method further includes the step of providing a second pole of the type described above, adjusting the length of the second pole to the first value, inserting the second pole between the upper and lower second-pole-receiving regions, and then adjusting the length of the second pole to the second value with the top end of the second pole mated with the upper second-pole-receiving region and the bottom end of the second pole mated with the lower second-pole-receiving region, such that the second pole is securely retained between the upper and lower second-pole-receiving regions. The method also includes the steps of providing a first illuminating assembly of the type described above and mounting it on at least one of the first pole, the second pole, and the second-pole-mounting member.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
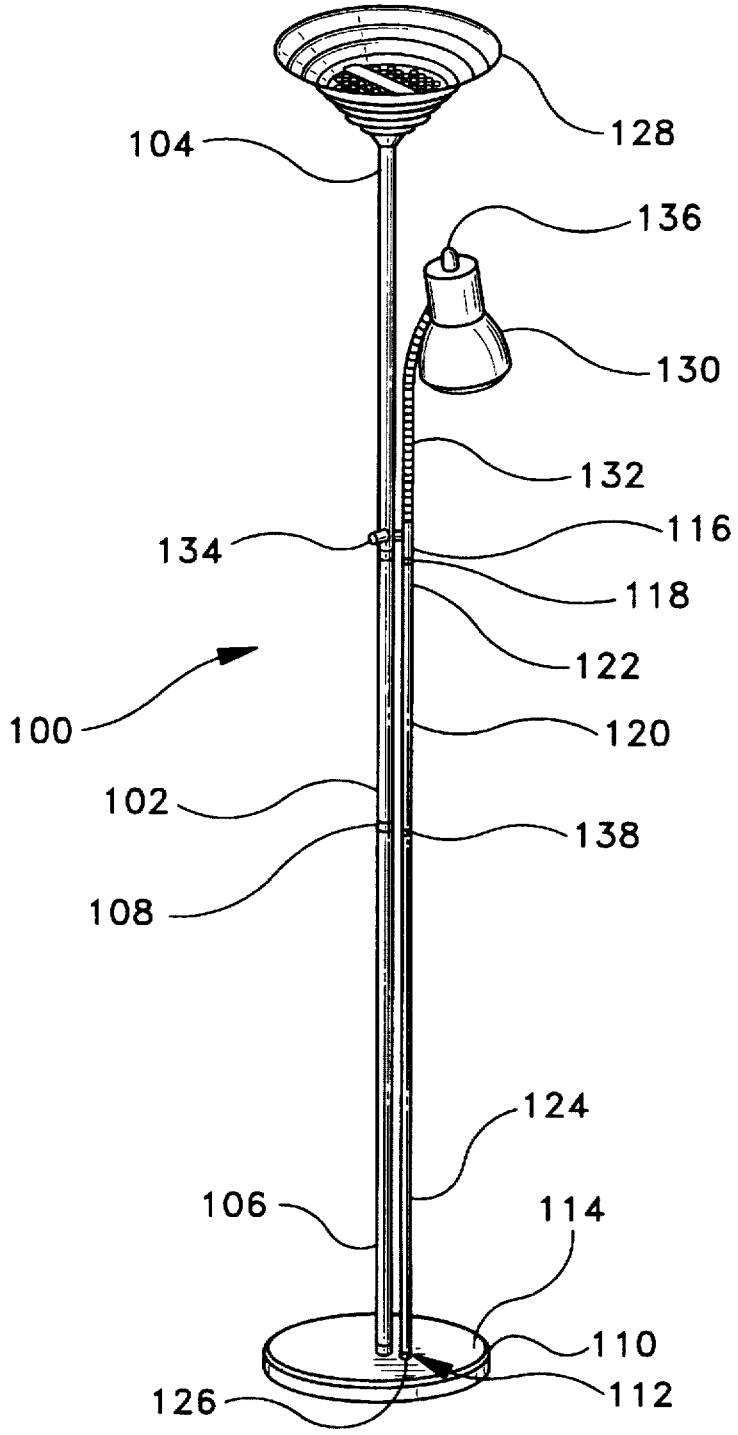
FIG. 1 is a perspective view of a floor lamp according to the present invention.
Figure 2:
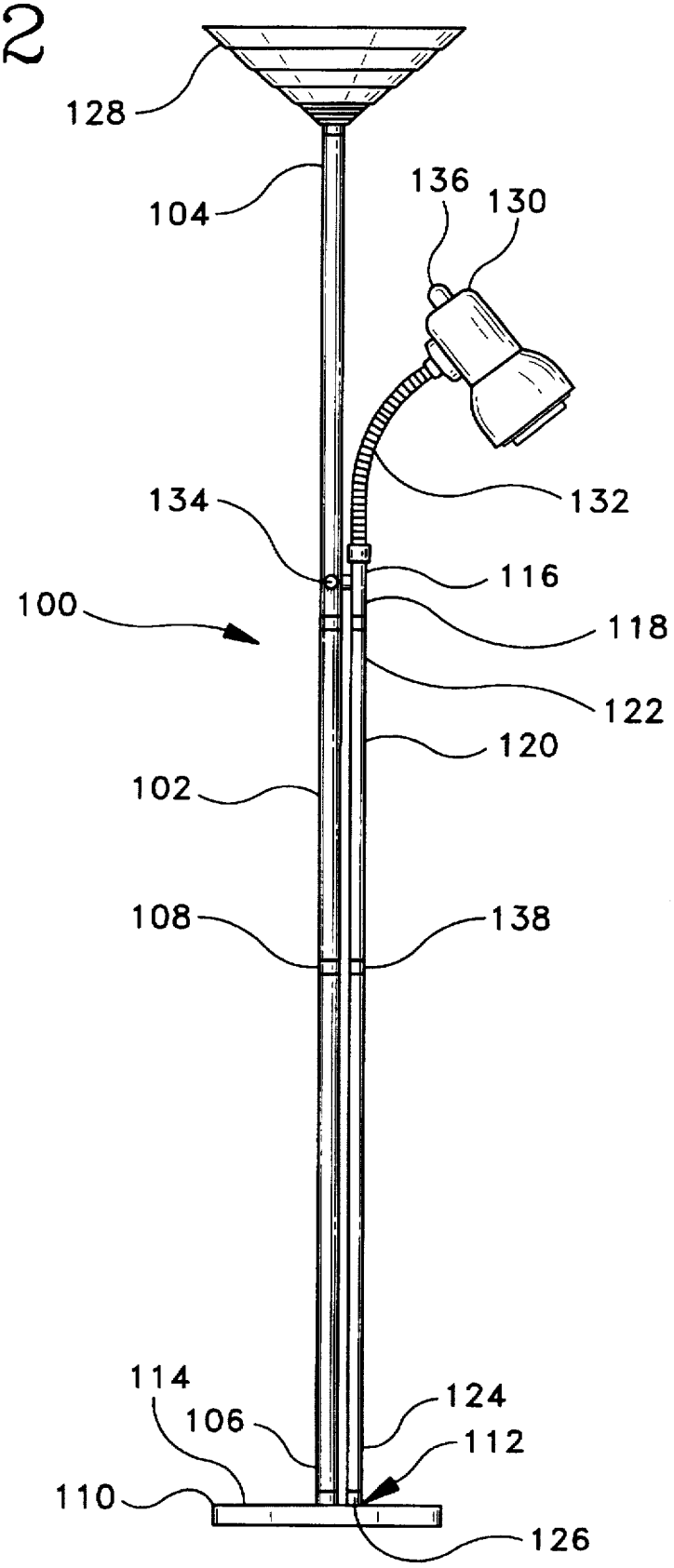
FIG. 2 is a left side view of the floor lamp of FIG. 1.
Figure 3:
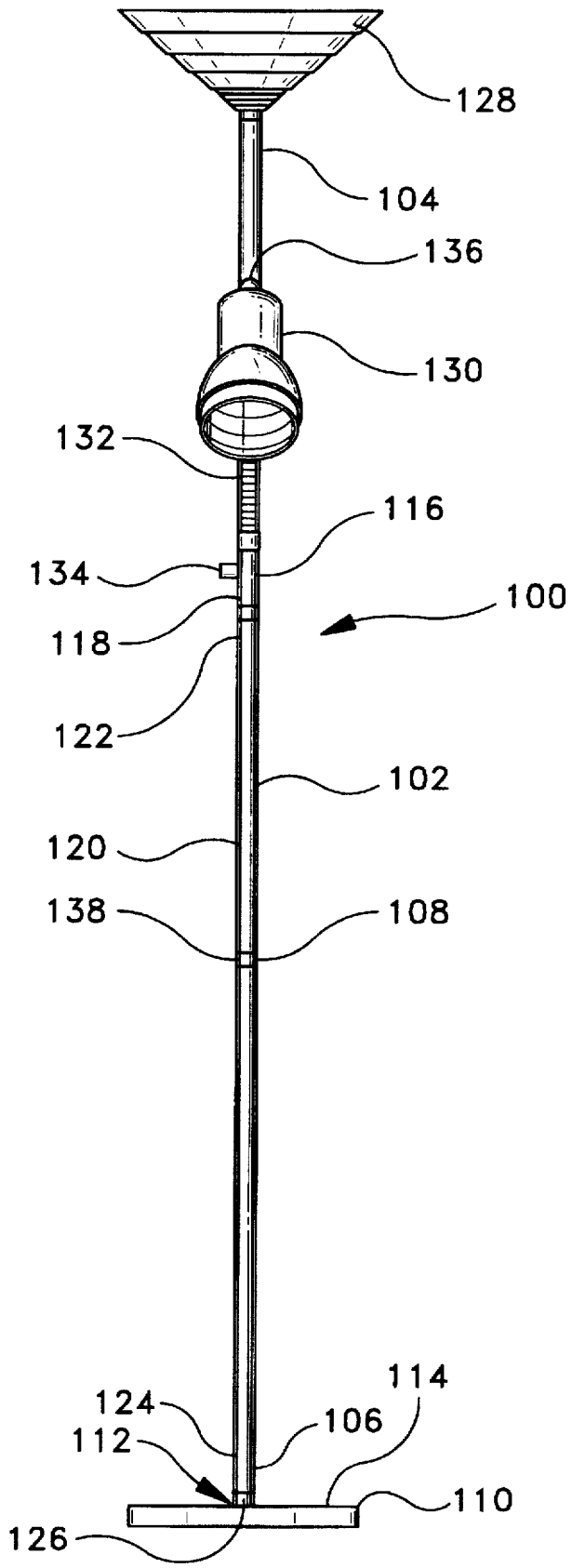
FIG. 3 is a front view of the floor lamp of FIG. 1.
Figure 4:
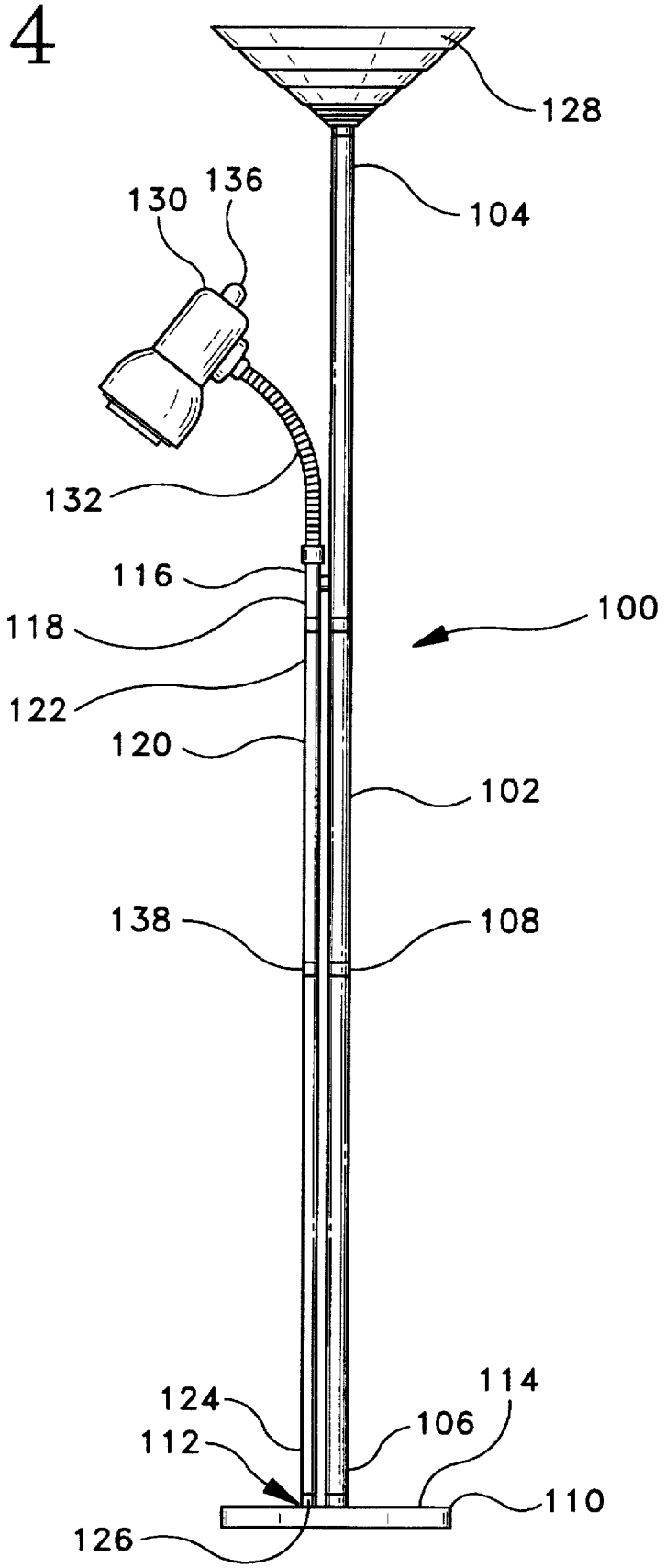
FIG. 4 is a right side view of the floor lamp of FIG. 1.
Figure 5:
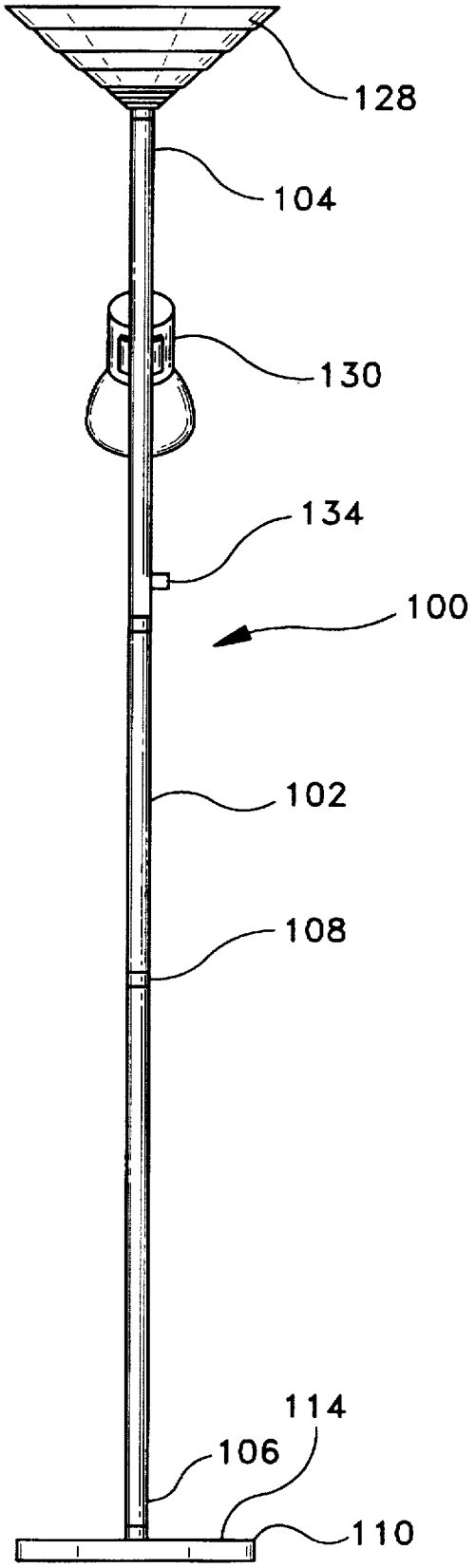
FIG. 5 is a rear view of the floor lamp of FIG. 1.

Referring initially to FIGS. 1–7, an easy-assembly dual-pole floor lamp of the present invention, designated generally as 100, includes a first pole 102 having a top end 104 and a bottom end 106. Lamp 100 is preferably provided as a kit containing the parts described herein. First pole 102 may include one or more ornamental spacers such as ornamental spacer 108. Lamp 100 also includes a base portion 110 which is configured to be secured to the bottom end 106 of the first pole 102, and which is so secured when lamp 100 is assembled. Base portion 110 has a lower second-pole-receiving region 112 which can be, for example, a generally upwardly-facing flat surface 114 of the base portion 110. Any other suitable type of region 112 can be employed, as discussed below.

Lamp 100 further includes a second-pole-mounting member such as item 116, which is secured to the first pole 102 at a predetermined distance above the lower second-pole-receiving region 112 (i.e., member 116 will be at such distance when lamp 100 is assembled). Second-pole-mounting member 116 includes an upper second-pole-receiving region 118, which is discussed in further detail below.

Lamp 100 also includes a second pole 120 having a top end 122 and a bottom end 124. Top end 122 of second pole 120 is configured to mate with upper second-pole-receiving region 118 of second-pole-mounting member 116. Bottom end 124 of second pole 120 is configured to mate with lower second-pole-receiving region 112 of base portion 110. Second pole 120 has a length which is adjustable over an adjustment range which extends at least between first and second values. Continuous adjustment, such as that provided by threads, is preferred, but discrete adjustment can also be employed. The first value of the length is selected to permit easy insertion of second pole 120 between upper second-pole-receiving region 118 and lower second-pole-receiving region 112. The second value of the length is selected for secure retention of second pole 120 between upper second-pole-receiving region 118 and lower second-pole-receiving region 112. When the lamp 100 is assembled, as shown in FIGS. 1–7, second pole 120 has its length adjusted to the second value and is securely retained between upper second-pole-receiving region 118 and lower second-pole-receiving region 112 with the top end 122 of second pole 120 mated with upper second-pole-receiving region 118, and the bottom end 124 of second pole 120 mated with lower second-pole-receiving region 112. Second pole 120 is preferably formed with a threaded trim ring 126 at its bottom end 124, for purposes to be discussed below.

It is to be appreciated that lower second-pole-receiving region 112 should generally be designed to mate with bottom end 124 of second pole 120 in any angular orientation, at least where an upper second-pole-receiving region which fixes the angular orientation of first pole 102 and second pole 120 is employed (such as region 118 of member 116). In addition to flat surface 114, region 112 could also be formed as, for example, an annular groove in base portion 110. When an upper second-pole-receiving region which permits freedom of angular orientation between poles 102, 120 is employed, the lower second-pole-receiving region could be, for example, a socket member or other structure less tolerant of varied angular orientation than flat surface 114 (of course, surface 114 or a groove could still be employed if desired).

Lamp 100 also includes a first illuminating assembly, such as halogen bulb and reflector assembly 128, which is configured to be mounted on at least one of first pole 102, second pole 120, and second-pole-mounting member 116, and which is so mounted when lamp 100 is assembled. Assembly 128 is preferably mounted on first pole 102, most preferably to top end 104 of first pole 102. Lamp 100 preferably also includes a second illuminating assembly, such as goose neck incandescent light assembly 130, which is configured to be mounted on second-pole-mounting member 116, and which is so mounted when lamp 100 is assembled. Goose neck incandescent light assembly 130 may include a flexible goose neck portion 132 which is configured to be mounted on second-pole-mounting member 116 via any suitable means, such as threads, bayonet mount, friction-fit, and the like. The first and second illuminating assemblies may be provided with electrical power by an arrangement to be discussed below. It is to be appreciated that many other configurations of illuminating assemblies may be employed; for example, one could use more than two assemblies. Further, the assemblies could be mounted in various locations, e.g., both on first pole 102. While it is possible to mount one or more illuminating assemblies directly on second pole 120, to achieve the full benefits of easy assembly with the present invention, this type of configuration is believed to be less desirable, since it could require wiring to be passed through the second pole 120.

It is also to be appreciated that the first and second illuminating assemblies may include any desired type of illuminating device, such as an incandescent bulb, a fluorescent bulb, a halogen bulb, and the like. Each illuminating device may be provided with a suitable switch, such as switch 134 which controls halogen bulb and reflector assembly 128, and switch 136 which controls goose neck incandescent light assembly 130.

First pole 102 may be approximately 5 feet 6 inches in height, second pole 120 may be approximately 3 feet 10½ inches in height, and flexible goose neck portion 132 may be approximately 10 inches in length. First pole 102 can have an outside diameter of about 1¼ inches and an inside diameter of about 1 3/16 inches. Second pole 120 can have an outside diameter of about 31/32 inch and an inside diameter of about 29/32 inch. The foregoing dimensions are illustrative and any suitable values can be used. Second pole 120 may include one or more ornamental spacers such as ornamental spacer 138.

Figure 9:
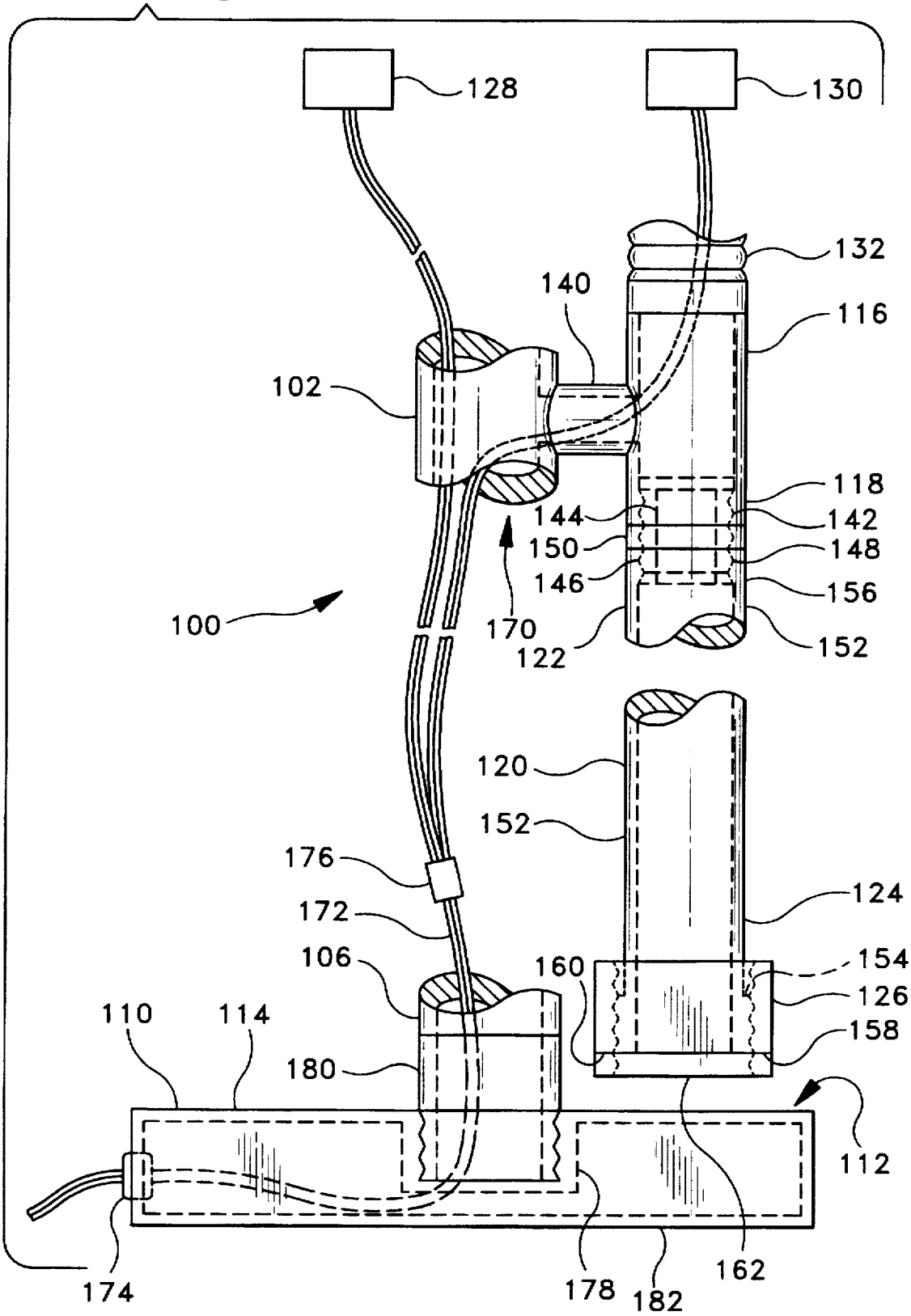
FIG. 9 is a semi-schematic left side view of the floor lamp of FIG. 1, showing details of the assembly thereof.
Figure 10:
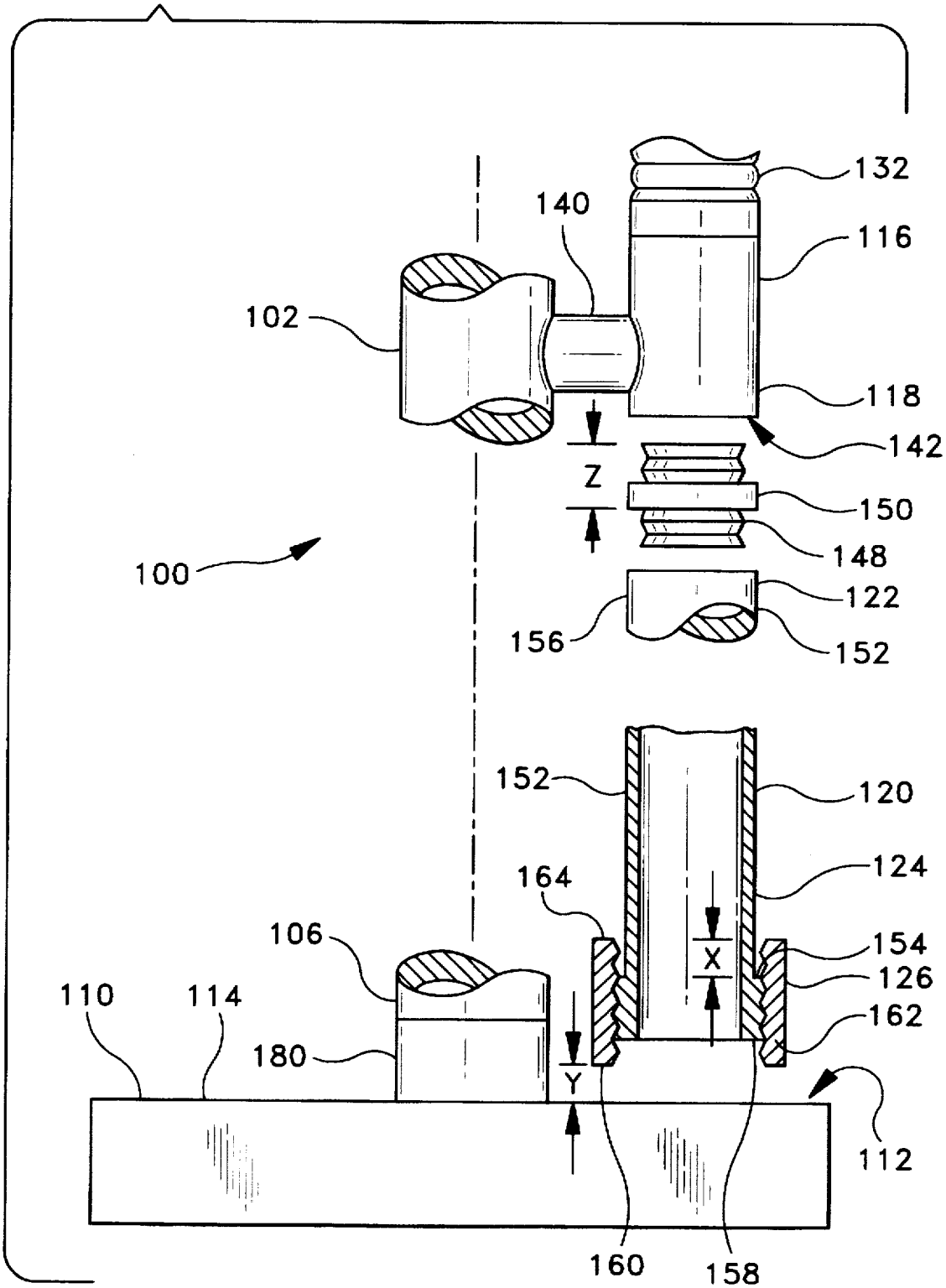
FIG. 10 is an exploded view similar to FIG. 9, taken partially in cross-section.

Reference should now be made to FIGS. 9 and 10. As shown therein, second-pole-mounting member 116 is preferably a hollow tube formed with the same diameter as second pole 120, and secured to first pole 102 via a hollow cross piece 140. Upper second-pole-receiving region 118 of second-pole-mounting member 116 is preferably formed with a cavity 142 configured to receive top end 122 of second pole 120. As best seen in FIG. 9, cavity 142 is preferably formed with internal threads 144. Top end 122 of the second pole 120 is preferably formed with external threads which are configured to mate with internal threads 144 of cavity 142. The external threads of top end 122 of second pole 120 are preferably formed using a separate piece, as follows. Second pole 120 is preferably formed, in part, from a hollow tube 152 which has internal threads 146 which are of the same pattern as internal threads 144 of cavity 142. An externally threaded coupling plug 148, which may be equipped with a coupling plug ring 150, is threaded into internal threads 146 of top end 122 of second pole 120, thereby presenting the external threads of plug 148 which are configured to mate with internal threads 144 of cavity 142 in upper second-pole-receiving region 118.

It is to be appreciated that the scheme shown in FIGS. 9 and 10 is only one manner in which upper second-pole-receiving region 118 and top end 122 of second pole 120 may be formed with mating threads. Many other configurations are possible. For example, external threads could be formed on second-pole-mounting member 116, with internal threads in top end 122 of second pole 120. Further, it is to be understood that cavity 142 need not be threaded, and could merely be provided to slidingly receive top end 122 of second pole 120 (which also need not be threaded). Yet farther, upper second-pole-receiving region 118 could simply be a flat surface which would abut top end 122 of second pole 120 and securely retain it by friction, and the flat surface could even be circumferential to permit different angular orientations between poles 102, 120.

Still referring to FIGS. 9 and 10, it will be seen that second pole 120 preferably includes a threaded trim ring 126 and a threaded main barrel portion having first and second ends, such as that formed by the hollow tube 152 which has raised annular threaded region 154, first end 156 and second end 158. Threaded trim ring 126 mates with the raised annular threaded region 154 of hollow tube 152 to provide at least a portion of the adjustment range of second pole 120. That is, second pole 120 can be lengthened or foreshortened by rotating threaded trim ring 126 with respect to raised annular threaded region 154 of hollow tube 152. Trim ring 126 may be located at either end 156, 158 of the main barrel portion formed by the hollow tube 152. Trim rings 126 may even be employed at both ends. It will be appreciated that trim ring 126 defines one of the top end 122 and the bottom end 124 of the second pole 120. As illustrated in FIGS. 9 and 10, trim ring 126 defines bottom end 124 of second pole 120. Of course, it could instead define top end 122.

Note that although reference character 124 generally designates the bottom end of second pole 120, bottom end 124 more precisely coincides with lower end 160 of threaded trim ring 126. Lower end 160 of threaded trim ring 126 may be provided with a washer or cushioning member 162, which can be annular, disk-like, or any other desired shape. Cushioning member 162 prevents marring of lower second-pole-receiving region 112 on base portion 110. Further, cushioning member 162 is advantageously formed of a material (such as rubber) which will yield a high coefficient of friction against lower second-pole-receiving region 112, in order to insure secure fastening of second pole 120. Similar considerations apply where trim ring 126 instead defines top end 122 of second pole 120; a suitable cushioning member could be suppled to interface with the corresponding upper second-pole-receiving region.

It will be appreciated that when threaded trim ring 126 defines one of the top 122 and bottom 124 ends of the second pole 120, the other end (here, 156) of the main barrel portion formed by hollow tube 152 will define the other of the top 122 and bottom 124 ends of the second pole 120. As illustrated in FIG. 9, where threaded trim ring 126 defines bottom end 124 of second pole 120, the opposite end (here, 156) of the main barrel portion formed by hollow tube 152 will generally define the top end 122 of second pole 120. As used herein, the expression "generally define" is intended to include situations, such as those shown in FIGS. 9 and 10, wherein a separate coupling member (or other auxiliary hardware), such as coupling plug 148, is inserted in the given end (here, 156) of hollow tube 152.

As depicted in FIGS. 9 and 10, it is preferable that threaded trim ring 126 define the bottom end 124 of second pole 120, and that ring 126 frictionally engage the lower second-pole-receiving region 112 of the base portion 110.

As shown in FIGS. 1–5, 9 and 10 threaded trim ring 126 and the threaded main barrel portion formed by hollow tube 152 are preferably configured to substantially conceal the threads on the threaded main barrel portion and the trim ring when the lamp 100 is in an assembled condition. This can be achieved as shown in FIGS. 9 and 10. The overall length of all components which form second pole 120, when the second pole 120 has its length adjusted to the first value of the adjustment range, must be less than the distance between upper second-pole-receiving region 118 and lower second-pole-receiving region 112. When all components forming second pole 120 are adjusted to the second value of the adjustment range, lower end 160 (preferably including cushion 162) of threaded trim ring 126 must securely engage lower second-pole-receiving region 112.

As shown in FIG. 10, lower end 160 of threaded trim ring 126 will normally be substantially coincident with second end 158 of hollow tube 152 when the length of second pole 120 is adjusted to the first value. Of course, there can be some protrusion of cushion 162 as shown in FIGS. 9 and 10. After top end 122 of second pole 120 is secured to upper second-pole-receiving region 118, threaded trim ring 126 is screwed downwards until lower end 160 (optionally including cushion 162) engages lower second-pole-receiving region 112. To ensure that the threads are substantially concealed when the lamp is in an assembled condition, as best seen in FIG. 10, distance X between the uppermost extent of raised annular threaded region 154 and the upper end 164 of trim ring 126 should be greater than the distance Y between the lower end 160 of trim ring 126 and the lower second-pole-receiving region 112 (with top end 122 mated with upper second-pole-receiving region 118). Suitable allowance should be made for compression of cushion 162. Consideration must also be given to any portion of second pole 120 which will be received within upper second-pole-receiving region 118. As shown in FIG. 10, this can include the distance Z between coupling plug ring 150 and the upper end of coupling plug 148. Assuming that the first value of the adjustment range for the length of second pole 120 is selected to just permit passage of pole 120 between lower second-pole-receiving region 112 and upper second-pole-receiving region 118, then distance X should also be greater than distance Z. Following these guidelines will result in at least substantial concealment of the threads on annular region 154; the threads of trim ring 126 are inherently concealed since they are internal.

It is to be understood that the specific embodiment of second pole 120 described herein, including the hollow tube 152 with raised annular threaded region 154 and threaded trim ring 126, is only one exemplary type of adjustable second pole 120 which can be used with the present invention. Many other configurations are possible, including but not limited to different types of mating threaded regions, as well as concentric, nesting, telescoping regions which might be held in place, for example, by friction. Further, threaded region 154 would be located elsewhere than at an end of tube 152.

As best seen in FIG. 9, in order to facilitate the supply of electrical power to first and second illuminating assemblies, such as halogen bulb and reflector assembly 128 and goose neck incandescent light assembly 130, first pole 102 is preferably formed with a wiring-receiving cavity 170 therein. Wiring-receiving cavity 170 is preferably in communication with second-pole-mounting member 116, for example, through hollow cross piece 140. Thus, the lamp 100 preferably further includes a wiring harness 172 which is configured to supply electrical power to the first and second illuminating assemblies, such as assemblies 128 and 130. The wiring harness 172 is preferably configured to be located within wiring-receiving cavity 170 and interface with the first illuminating assembly, such as halogen bulb and reflector assembly 128, through the cavity 170. Further, the wiring harness 172 preferably is configured to interface with the second illuminating assembly, such as goose neck incandescent light assembly 130, through the second-pole-mounting member 116. Wiring harness 172 may include an ordinary lamp cord which passes through a suitable insulating grommet 174 located on base portion 110. In order to facilitate parallel wiring of assemblies 128, 130, a suitable splice block 176 may be provided. If desired, splice block 176 can simply be in the form of ordinary wire nuts. Of course, when lamp 100 is assembled, harness 172 is normally located in cavity 170 and normally interfaces with assembly 128 through cavity 170 and with assembly 130 through member 116. Methods of interconnecting the ends of the lamp cord with different types of light sockets are well known.

Figure 6:
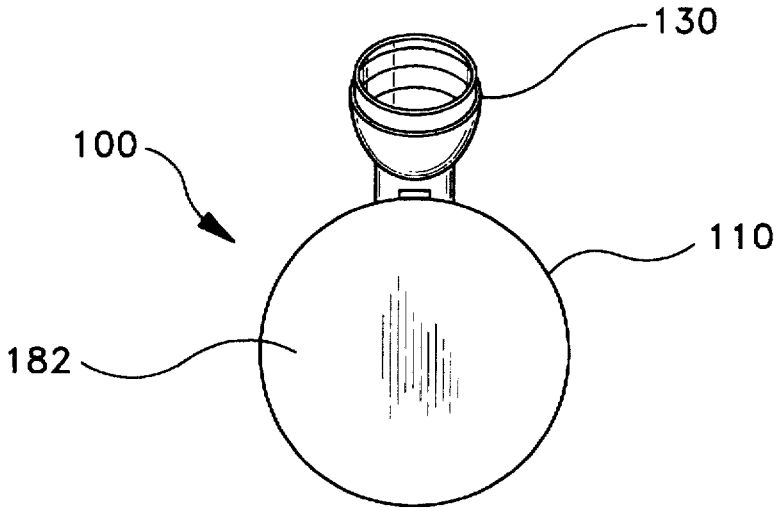
FIG. 6 is a bottom view of the floor lamp of FIG. 1.
Figure 7:
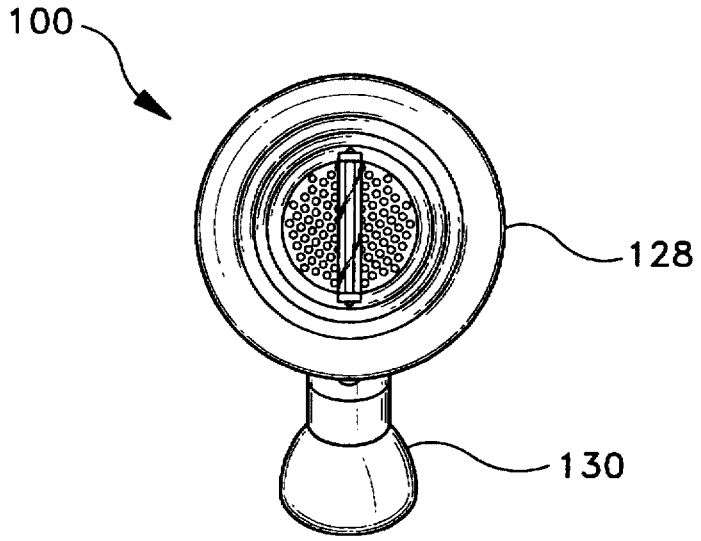
FIG. 7 is a top view of the floor lamp of FIG. 1.
Figure 8:
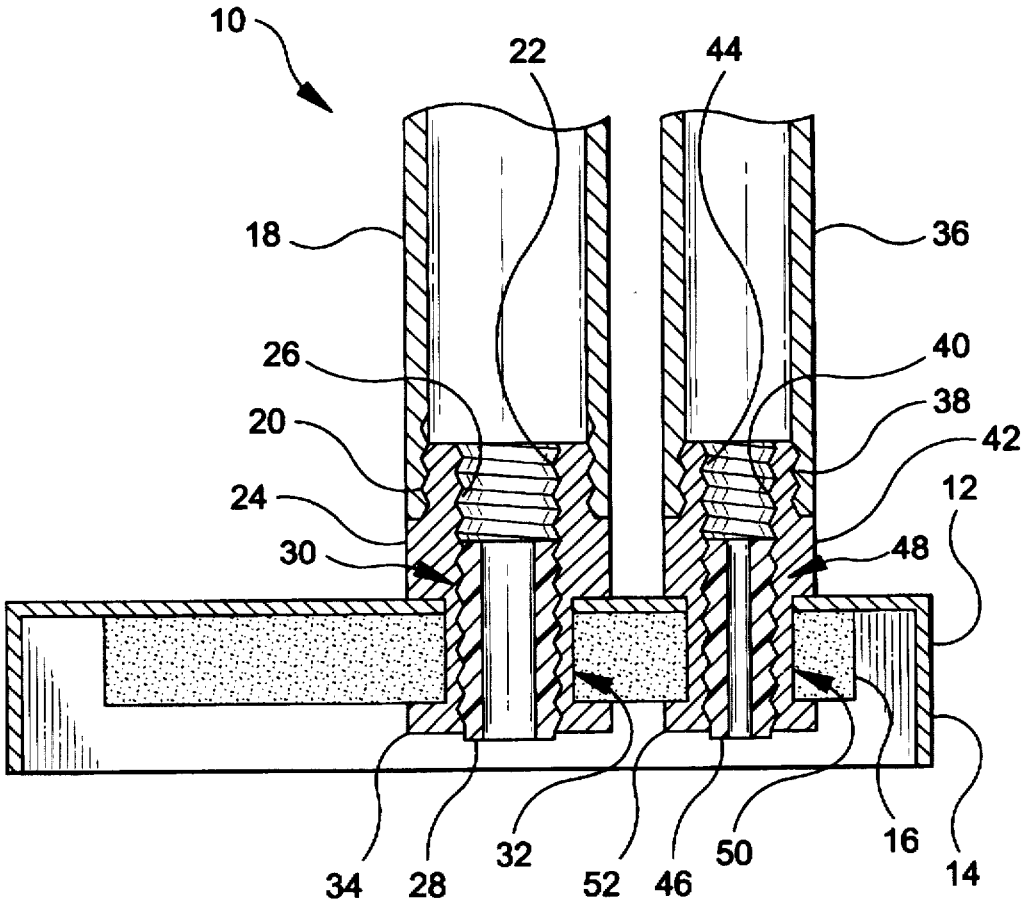
FIG-8 PRIOR ART
FIG. 8 is a cross-sectional view showing assembly of a prior art floor lamp.

As shown in FIG. 9, bottom end 106 of first pole 102 may be fastened to base portion 110 by threading into a suitable boss 178. A decorative portion 180 may be provided to obtain a visual match with threaded trim ring 126. It is to be understood that bottom end 106 of first pole 102 may be fastened to base portion 110 in any convenient fashion, including the prior art technique shown in FIG. 8. As shown in FIGS. 6 and 9, base portion 110 includes a lower cover 182 which is optional. Base portion 110 can be formed with an open bottom region, as shown in the prior art FIG. 8, and may also include a suitable weight, such as weight 16, to provide stability.

In view of the foregoing discussion, it will be appreciated that a method for assembling an easy-assembly dual-pole floor lamp kit, according to the present invention, includes the steps of: (a) providing a first pole, base and mounting member assembly including a first pole 102 of the type described above, a base portion 110 of the type described above, and a second-pole-mounting member 116 of the type described above; (b) providing a second pole 120 of the type described above, which has the above-described adjustable length; (c) adjusting the length of the second pole 120 to the first value (i.e., for easy insertion of the second pole between the upper and lower second-pole-receiving regions); (d) inserting the second pole 120 between the upper 118 and lower 112 second-pole-receiving regions; (e) adjusting the length of the second pole 120 to the second value (i.e., the value of the length selected for secure retention of the second pole) with the top end 122 of the second pole 120 mated with the upper second-pole-receiving region 118 and the bottom end 124 of the second pole 120 mated with lower second-pole-receiving region 112, such that the second pole 120 is securely retained between the upper 118 and lower 112 second-pole-receiving regions; (f) providing a first illuminating assembly (such as assembly 128) of the type described above; and (g) mounting the first illuminating assembly on at least one of the first pole 102, second pole 120, and second-pole-mounting member 116.

Step (a), that of providing the first pole, base and mounting member assembly preferably includes the substeps of providing the first pole 102, which has top end 104 and bottom end 106, and which has the second pole mounting member 116 secured to it; providing the base portion 110 as a separate piece configured to be secured to the bottom end 106 of the first pole 102; and securing the separate piece to the bottom end 106 of the first pole 102, such that the first pole, base and mounting member assembly is provided.

Furthermore, in step (a), the upper second-pole-receiving region 118 is preferably formed with a cavity 142, as described above, and the method preferably further comprises the additional step of inserting the top end 122 of the second pole 120 into the cavity 142. As noted, the cavity 142 is preferably formed with internal threads 144, and the top end 122 of second pole 120 is preferably formed with external threads (such as those of coupling plug 148) which are configured to mate with the internal threads 144 of the cavity 142. In this case, the inserting step just described preferably comprises threading the top end 122 of the second pole 120 into the cavity 142.

In the method, the upper second-pole-receiving region 118 and the top end 122 of the second pole 120 are preferably formed with mating threads, as described above. In this case, the method preferably includes the additional step of threading the top end 122 of the second pole 120 and the upper second-pole-receiving region 118 together.

In the method of assembly according to the present invention, it is preferable that in step (b), the second pole 120 includes a threaded main barrel portion (such as that formed by hollow tube 152 having first and second ends 156, 158) and a threaded trim ring 126 mated with the threaded main barrel portion formed by hollow tube 152, and moveable with respect to it, to provide at least a portion of the adjustment range. As described above, the trim ring 126 is located at one of the ends 156, 158 of the threaded main barrel portion formed by hollow tube 152, and it defines one of the top end 122 and bottom end 124 of the second pole 120. The other end of the main barrel portion formed by hollow tube 152 generally defines the other of the top end 122 and bottom end 124 of the second pole 120. When the threaded main barrel and trim ring are employed, step (c) preferably includes rotating the trim ring 126 with respect to the threaded main barrel portion formed by the hollow tube 152 in a first rotational sense, so that the ring 126 approaches that end of the main barrel portion formed by hollow tube 152 at which the trim ring 126 is located. Further, step (e) preferably includes rotating the trim ring 126 in a second rotational sense which is opposite to the first rotational sense until the trim ring 126 contacts the corresponding one of the upper and lower second-pole-receiving regions 118, 112.

Preferably, as noted above, the threaded trim ring 126 defines the bottom end 124 of the second pole 120 and is configured to frictionally engage the lower second-pole-receiving region 112 of the base portion 110. In this case, the above-mentioned rotation of the trim ring in the second rotational sense in step (e) includes rotating the trim ring 126 until it contacts the lower second-pole-receiving region 112 and is securely frictionally engaged with region 112. Most preferably, in this case, both the threaded main barrel portion formed by hollow tube 152 and the threaded trim ring 126 are configured to substantially conceal the threads when the lamp kit is assembled. The method then preferably includes the additional step of ceasing the rotation in the second rotational sense before any threads on the threaded main barrel portion formed by hollow tube 152 (including raised annular threaded region 154) or the trim ring 126 are exposed to view.

Finally, in the method of assembly according to the present invention, it is preferable that the first pole 102 have a wiring-receiving cavity 170 formed therein, as described above. Further, it is also preferable that the first illuminating assembly, such as halogen bulb and reflector assembly 128, be configured to be mounted on first pole 102, and that step (g) include mounting the first illuminating assembly on first pole 102. The method preferably further comprises the additional steps of providing a second illuminating assembly, such as goose neck incandescent light assembly 130, configured to be mounted on second-pole-mounting member 116; mounting the second illuminating assembly on the second-pole-mounting member 116; providing a wiring harness 172 of the type described above; and then installing the wiring harness 172 in the wiring-receiving cavity 170 in a manner such that the wiring harness interfaces with the first illuminating assembly through the cavity 170, and with the second illuminating assembly through the second-pole-mounting member 116.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An easy-assembly dual-pole floor lamp comprising:

a first pole having a top end and a bottom end;

a base portion secured to said bottom end of said first pole, said base portion having a lower second-pole-receiving region;

a second-pole-mounting member secured to said first pole at a predetermined distance above said lower second-pole-receiving region, said second-pole-mounting member having an upper second-pole-receiving region;

a second pole having a top end and a bottom end, said top end of said second pole being configured to mate with said upper second-pole-receiving region, said bottom end of said second pole being configured to mate with said lower second-pole-receiving region, said second pole having a length adjustable over an adjustment range which extends at least between first and second values, said first value of said length being selected for easy insertion of said second pole between said upper and lower second-pole-receiving regions, said second value of said length being selected for secure retention of said second pole between said upper and lower second-pole-receiving regions, said second pole having said length adjusted to said second value and being securely retained between said upper and lower second-pole-receiving regions with said top end of said second pole mated with said upper second-pole-receiving region and said bottom end of said second pole mated with said lower second-pole-receiving regions mating of at least one of:

said top end of said second pole with said upper second-pole-receiving region; and said bottom end of said second pole with said lower second-pole-receiving region being accomplished by frictional engagement between a respective one of said top and bottom ends and a corresponding one of said upper and lower second-pole-receiving regions, without threaded engagement between said respective one of said top and bottom ends and said corresponding one of said upper and lower second-pole-receiving regions; and a first illuminating assembly mounted on at least one of said first pole, said second pole, and said second-pole-mounting member.

2. The lamp of claim 1, wherein said upper second-pole-receiving region is formed with a cavity for receiving said top end of said second pole.

3. The lamp of claim 2, wherein said cavity is formed with internal threads and said top end of said second pole is formed with external threads configured to mate with said internal threads.

4. The lamp of claim 1, wherein said upper second-pole-receiving region and said top end of said second pole are formed with mating threads.

5. The lamp of claim 1, wherein said second pole includes a threaded main barrel portion having first and second ends and a threaded trim ring mated with said threaded main barrel portion and movable with respect to said threaded main barrel portion to provide at least a portion of said adjustment range, said trim ring being located at one of said ends of said main barrel portion and defining one of said top end and said bottom end of said second pole, another of said ends of said main barrel portion generally defining another of said top end and said bottom end of said second pole.

6. The lamp of claim 5, wherein said threaded trim ring defines said bottom end of said second pole and frictionally engages said lower second-pole-receiving region of said base portion.

7. The lamp of claim 6, wherein said threaded main barrel portion and said threaded trim ring are configured to substantially conceal said threads when said lamp is in an assembled condition.

8. The lamp of claim 1, wherein:

said first pole has a wiring-receiving cavity formed therein, said wiring-receiving cavity being in communication with said second-pole-mounting member; and said first illuminating assembly is mounted on said first pole; further comprising:

a second illuminating assembly mounted on said second-pole-mounting member; and a wiring harness configured to supply electrical power to said first and second illuminating assemblies, said wiring harness being located in said wiring-receiving cavity and interfacing with said first illuminating assembly through said wiring-receiving cavity and with said second illuminating assembly through said second-pole-mounting member.

9. An easy-assembly dual-pole floor lamp kit comprising:

a first pole having a top end and a bottom end;

a base portion configured to be secured to said bottom end of said first pole, said base portion having a lower second-pole-receiving region;

a second-pole-mounting member secured to said first pole at a predetermined distance above said lower second-pole-receiving region, said second-pole-mounting member having an upper second-pole-receiving region;

a second pole having a top end and a bottom end, said top end of said second pole being configured to mate with said upper second-pole-receiving region, said bottom end of said second pole being configured to mate with said lower second-pole-receiving region, said second pole having a length adjustable over an adjustment range which extends at least between first and second values, said first value of said length being selected for easy insertion of said second pole between said upper and lower second-pole-receiving regions, said second value of said length being selected for secure retention of said second pole between said upper and lower second-pole-receiving regions, configuration for mating of at least one of:

said top end of said second pole with said upper second-pole-receiving region; and said bottom end of said second pole with said lower second-pole-receiving region being by frictional engagement between a respective one of said top and bottom ends and a corresponding one of said upper and lower second-pole-receiving regions, without threaded engagement between said respective one of said top and bottom ends and said corresponding one of said upper and lower second-pole-receiving regions; and a first illuminating assembly configured to be mounted on at least one of said first pole, said second pole, and said second-pole-mounting member.

10. The lamp kit of claim 9, wherein said upper second-pole-receiving region is formed with a cavity for receiving said top end of said second pole.

11. The lamp kit of claim 10, wherein said cavity is formed with internal threads and said top end of said second pole is formed with external threads configured to mate with said internal threads.

12. The lamp kit of claim 9, wherein said upper second-pole-receiving region and said top end of said second pole are formed with mating threads.

13. The lamp kit of claim 9, wherein said second pole includes a threaded main barrel portion having first and second ends and a threaded trim ring mated with said threaded main barrel portion and movable with respect to said threaded main barrel portion to provide at least a portion of said adjustment range, said trim ring being located at one of said ends of said main barrel portion and defining one of said top end and said bottom end of said second pole, another of said ends of said main barrel portion generally defining another of said top end and said bottom end of said second pole.

14. The lamp kit of claim 13, wherein said threaded trim ring defines said bottom end of said second pole and is configured to frictionally engage said lower second-pole-receiving region of said base portion.

15. The lamp kit of claim 14, wherein said threaded main barrel portion and said threaded trim ring are configured to substantially conceal said threads when said lamp kit is assembled.

16. The lamp kit of claim 9, wherein:

said first pole has a wiring-receiving cavity formed therein, said wiring-receiving cavity being in communication with said second-pole-mounting member; and said first illuminating assembly is configured to be mounted on said first pole;

further comprising:

a second illuminating assembly configured to be mounted on said second-pole-mounting member; and a wiring harness configured to supply electrical power to said first and second illuminating assemblies, said wiring harness being configured to be located in said wiring-receiving cavity and to interface with said first illuminating assembly through said wiring-receiving cavity and with said second illuminating assembly through said second-pole-mounting member.

17. A method for assembling an easy-assembly dual-pole floor lamp kit, said method comprising the steps of:

(a) providing a first pole, base and mounting member assembly including:

a first pole having a top end and a bottom end;

a base portion secured to said bottom end of said first pole, said base portion having a lower second-pole-receiving region; and a second-pole-mounting member secured to said first pole at a predetermined distance above said lower second-pole-receiving region, said second-pole-mounting member having an upper second-pole-receiving region;

(b) providing a second pole having a top end and a bottom end, said top end of said second pole being configured to mate with said upper second-pole-receiving region, said bottom end of said second pole being configured to mate with said lower second-pole-receiving region, said second pole having a length adjustable over an adjustment range which extends at least between first and second values, said first value of said length being selected for easy insertion of said second pole between said upper and lower second-pole-receiving regions, said second value of said length being selected for secure retention of said second pole between said upper and lower second-pole-receiving regions;

(c) adjusting said length of said second pole to said first value;

(d) inserting said second pole between said upper and lower second-pole-receiving regions;

(e) adjusting said length of said second pole to said second value with said top end of said second pole mated with said upper second-pole-receiving region and said bottom end of said second pole mated with said lower second-pole-receiving region, mating of at least one of:

said top end of said second pole with said upper second-pole-receiving region; and said bottom end of said second pole with said lower second-pole-receiving region being accomplished by frictional engagement between a respective one of said top and bottom ends and a corresponding one of said upper and lower second-pole-receiving regions, without threaded engagement between said respective one of said top and bottom ends and said corresponding one of said upper and lower second-pole-receiving regions, whereby said second pole is securely retained between said upper and lower second-pole-receiving regions;

(f) providing a first illuminating assembly configured to be mounted on at least one of said first pole, said second pole, and said second-pole-mounting member; and (g) mounting said first illuminating assembly on at least one of said first pole, said second pole, and said second-pole-mounting member.

18. The method of claim 17, wherein step (a) comprises the sub-steps of:

providing said first pole having said top end and said bottom end and having said second-pole mounting member secured to said first pole, providing said base portion as a separate piece configured to be secured to said bottom end of said first pole; and securing said separate piece to said bottom end of said first pole, whereby said first pole, base and mounting member assembly is provided.

19. The method of claim 17, wherein in step (a), said upper second-pole-receiving region is formed with a cavity for receiving said top end of said second pole, said method further comprising the additional step of inserting said top end of said second pole into said cavity.

20. The method of claim 19, wherein said cavity is formed with internal threads and said top end of said second pole is formed with external threads configured to mate with said internal threads, and wherein said step of inserting said top end comprises threading said top end of said second pole into said cavity.

21. The method of claim 17, wherein said upper second-pole-receiving region and said top end of said second pole are formed with mating threads, said method further comprising the additional step of threading said top end of said second pole and said upper second-pole-receiving region together.

22. The method of claim 17, wherein in step (b), said second pole includes a threaded main barrel portion having first and second ends and a threaded trim ring mated with said threaded main barrel portion and movable with respect to said threaded main barrel portion to provide at least a portion of said adjustment range, said trim ring being located at one of said ends of said main barrel portion and defining one of said top end and said bottom end of said second pole, another of said ends of said main barrel portion generally defining another of said top end and said bottom end of said second pole, and wherein:

step (c) comprises rotating said trim ring with respect to said threaded main barrel portion in a first rotational sense so that said ring approaches said one of said ends of said main barrel portion at which said trim ring is located; and step (e) comprises rotating said trim ring in a second rotational sense opposite said first rotational sense until said trim ring contacts one of said upper and lower second-pole-receiving regions.

23. The method of claim 22, wherein said threaded trim ring defines said bottom end of said second pole and is configured to frictionally engage said lower second-pole-receiving region of said base portion, and wherein step (e) includes rotating said trim ring until said trim ring contacts said lower second-pole-receiving region and is securely frictionally engaged therewith.

24. The method of claim 23, wherein said threaded main barrel portion and said threaded trim ring are configured to substantially conceal said threads when said lamp kit is assembled, said method further comprising the additional step of ceasing said rotating in said second rotational sense before any threads on said threaded main barrel portion are exposed to view.

25. The method of claim 23, wherein said threaded main barrel portion and said threaded trim ring are configured to substantially conceal said threads when said lamp kit is assembled, further comprising the additional step of ceasing said rotating in said second rotational sense before any threads on said trim ring are exposed to view.

26. The method of claim 17, wherein:

in step (a), said first pole has a wiring-receiving cavity formed therein, said wiring-receiving cavity being in communication with said second-pole-mounting member;

in step (f), said first illuminating assembly is configured to be mounted on said first pole; and step (g) comprises mounting said first illuminating assembly on said first pole;

said method further comprising the additional steps of:

providing a second illuminating assembly configured to be mounted on said second-pole-mounting member;

mounting said second illuminating assembly on said second-pole-mounting member;

providing a wiring harness configured to supply electrical power to said first and second illuminating assemblies, said wiring harness configured to be located in said wiring-receiving cavity and to interface with said first illuminating assembly through said wiring-receiving cavity and with said second illuminating assembly through said second-pole-mounting member; and installing said wiring harness in said wiring-receiving cavity in a manner such that said wiring harness interfaces with said first illuminating assembly through said wiring-receiving cavity and with said second illuminating assembly through said second-pole-mounting member.

* * * * *

UNITED STATES PATENT AND TRADEMARK OFFICE

CERTIFICATE OF CORRECTION

PATENT NO. : 5,800,054
DATED : September 1, 1998
INVENTOR(S) : Lo

It is certified that error appears in the above-indentified patent and that said Letters Patent is hereby corrected as shown below:

In Column 10, Line 19, the patent now reads "regions" this should read --region,--.

Signed and Sealed this
Fifth Day of January, 1999

*Attest:*

*Attesting Officer*

*Acting Commissioner of Patents and Trademarks*